US006177170B1

(12) United States Patent
Nash et al.

(10) Patent No.: US 6,177,170 B1
(45) Date of Patent: Jan. 23, 2001

(54) VELVET-LIKE JACQUARD FABRICS AND PROCESSES FOR MAKING THE SAME

(75) Inventors: John L. Nash, Burlington; Lynn M. Pappas, Greensboro, both of NC (US)

(73) Assignee: Burlington Industries, Inc., Greensboro, NC (US)

( * ) Notice: Under 35 U.S.C. 154(b), the term of this patent shall be extended for 0 days.

(21) Appl. No.: 09/220,793

(22) Filed: Dec. 28, 1998

(51) Int. Cl.[7] ..... B32B 33/00; B32B 3/02; D06C 11/00; D04B 7/12

(52) U.S. Cl. ..... 428/91; 428/92; 428/93; 428/95; 26/29 R; 66/194

(58) Field of Search ..... 428/91, 93, 95, 428/85, 92, 97; 26/29 R; 66/194

(56) References Cited

U.S. PATENT DOCUMENTS

| | | | | |
|---|---|---|---|---|
| 3,669,818 | | 6/1972 | Stark . | |
| 3,785,016 | | 1/1974 | Hergert . | |
| 3,969,797 | | 7/1976 | Riedel et al. . | |
| 4,000,342 | | 12/1976 | Rochelle et al. . | |
| 4,112,560 | | 9/1978 | Willbanks . | |
| 4,282,635 | | 8/1981 | Engels . | |
| 4,482,594 | | 11/1984 | Stousland . | |
| 4,712,281 | * | 12/1987 | Scheller | 28/162 |
| 4,756,340 | * | 7/1988 | Janssen | 139/397 |
| 5,084,322 | * | 1/1992 | Brioschi et al. | 428/93 |
| 5,180,401 | * | 1/1993 | Owenby et al. | 8/478 |
| 5,284,034 | | 2/1994 | Weis et al. . | |
| 5,427,723 | | 6/1995 | Kugler et al. . | |
| 5,539,964 | | 7/1996 | Russum et al. . | |
| 5,557,950 | | 9/1996 | Richards et al. . | |

FOREIGN PATENT DOCUMENTS

| | | |
|---|---|---|
| 657 | 3/1853 | (GB) . |
| 184 | 1/1854 | (GB) . |
| 247 | 1/1862 | (GB) . |
| 2144 | 4/1883 | (GB) . |
| 8547 | 3/1893 | (GB) . |
| 8948 | 4/1906 | (GB) . |

OTHER PUBLICATIONS

Marjory L. Joseph. Textile Science. Cbs College Publishing. 1986. pp. 227–228.*

* cited by examiner

*Primary Examiner*—Terrel Morris
*Assistant Examiner*—Christopher C. Pratt
(74) *Attorney, Agent, or Firm*—Nixon & Vanderhye P.C.

(57) ABSTRACT

Fabrics and methods of making such fabrics whereby no evident pile structure is present in raised pattern areas on the face of the fabric. The construction of the fabric is nonetheless such that the yarns forming the raised pattern areas are more susceptible to napping as compared to the yarns forming the recessed ground regions of the fabric. This fabric construction of selected yarns will thus permit preferential napping of the pattern areas to be achieved (e.g., using conventional napping wires) while the adjacent ground regions of the fabric remain substantially unnapped. Subsequent shearing of the napped pattern areas thereby results in a velvet-like hand being achieved.

9 Claims, 2 Drawing Sheets

VELVET-LIKE JACQUARD FABRICS AND PROCESSES FOR MAKING THE SAME

FIELD OF THE INVENTION

Figure 1:
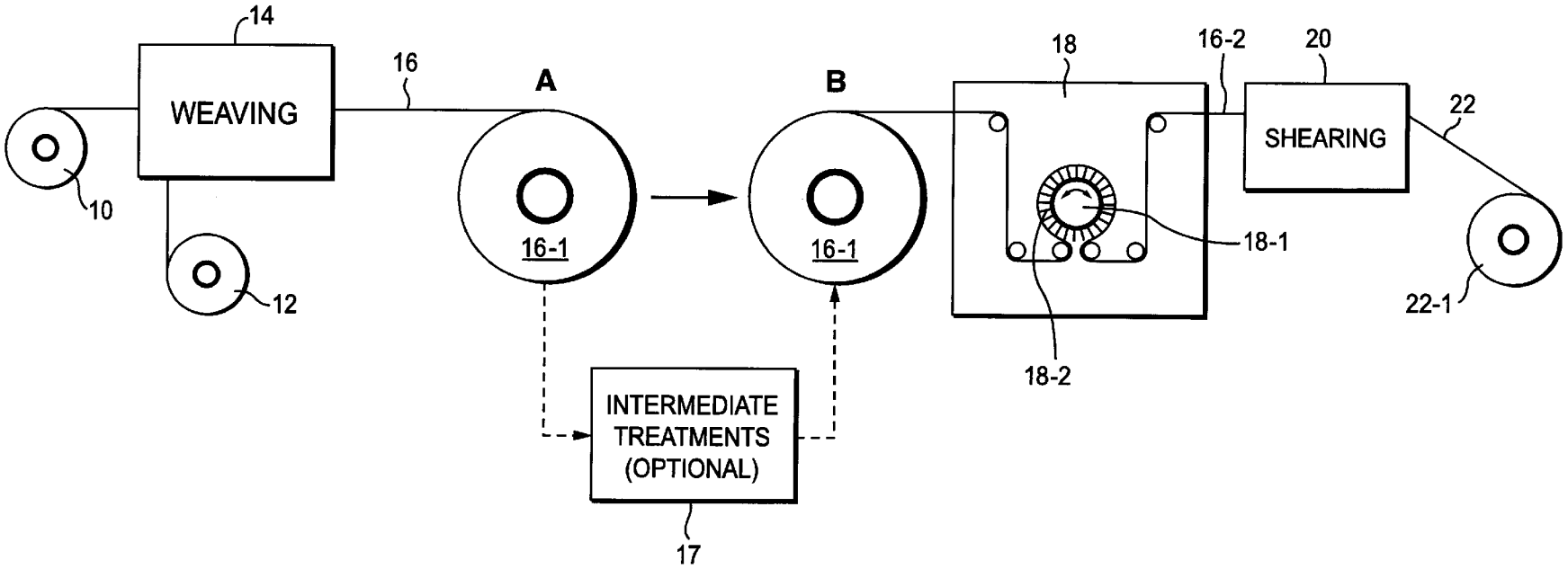

The present invention relates generally to velvet-like fabrics and methods of making the same. In preferred forms, the present invention is embodied in woven fabrics having velvet-like patterns on the fabric face, and to methods of making such fabrics. In especially preferred forms, the present invention is embodied in velvet-like Jacquard fabrics and methods of making the same.

BACKGROUND OF THE INVENTION

Historically, the term "velvet" has long referred to a plush woven fabric of distinctive appearance and hand. However, the comparative low productivity inherent in the weaving of such a fabric has caused market erosion of the traditional velvet product in many end uses, e.g., as upholstery fabrics, by tufted and knitted products that are similar in appearance and hand. The tufted and knitted products have come to be called "velvet" as well.

It has previously been known to form a woven-type "velvet" upholstery fabric on a fine-gauge, loop tufting or knitting machine. After tufting or knitting, the material is subsequently sheared to give the desired appearance and hand. The prior art tufted and knitted velvet fabrics tend, however, to have occasional unsheared loops which diminish the luxurious appearance of the finished product when used in applications traditionally reserved for the more expensive woven velvets. Machinery exists, however, which enable the loop to be cut on the knitting or tufting machine which eliminates such uncut loops. While eliminating the uncut loops, the resulting knitted and tufted fabrics still do not have the luxurious appearance available in the more expensive woven velvet fabrics.

It is also well known in this art to employ Jacquard weaving techniques to produce surface-patterned fabrics which may be used in a variety of end-use applications. in this regard, Jacquard weaving has in the past typically utilized a highly versatile pattern mechanism (e.g., electronically controlled pattern systems or the more traditional series of punch cards) to permit the production of large, intricate designs which control the individual action of the warp threads for the passage of each pick.

While cut pile Jacquard fabrics are known, it was necessary during the weaving process to form raised loops or piles which are then subsequently cut by conventional pile-cutting knives. However, forming loops or piles in Jacquard fabrics reduces significantly the productivity of the loom.

It would therefore be desirable if woven fabrics, particularly Jacquard fabrics, could be produced efficiently that have a velvet-like pattern on the fabric's face. It is towards fulfilling such a need that the present invention is directed.

SUMMARY OF THE INVENTION

Broadly, the present invention relates to fabrics and methods of making such fabrics whereby no evident pile structure is present in raised pattern areas on the face of the fabric. The construction of the fabric is nonetheless such that the yarns forming the raised pattern areas are more susceptible to napping as compared to the yarns forming the recessed ground regions of the fabric. This fabric construction of selected yarns will thus permit preferential napping of the pattern areas to be achieved (e.g., using conventional napping wires) while the adjacent ground regions of the fabric remain substantially unnapped. Subsequent shearing of the napped pattern areas thereby results in a velvet-like hand being achieved.

Further aspects and advantages of this invention will become more clear after careful consideration is given to the following detailed description of the preferred exemplary embodiments thereof.

BRIEF DESCRIPTION OF THE ACCOMPANYING DRAWINGS

Figure 2A:
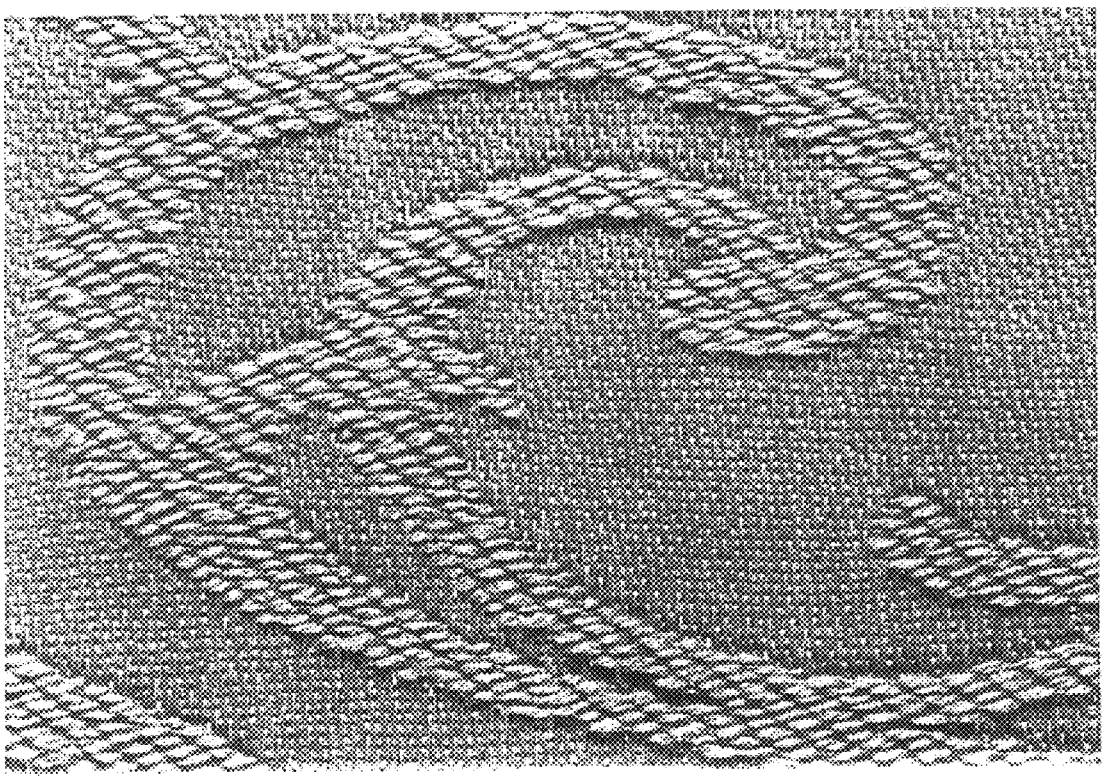
Figure 2B:
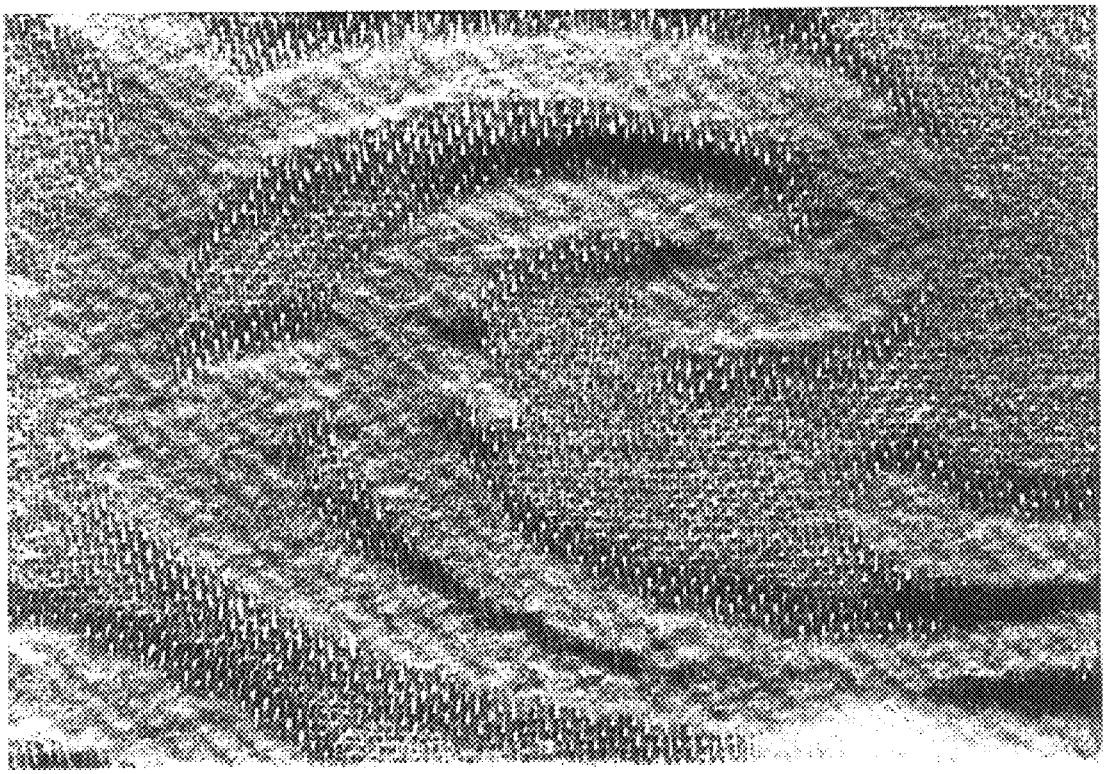

Reference will hereinafter be made to the accompanying drawings wherein like reference numerals throughout the various FIGURES denote like structural elements, and wherein, FIG. 1 is a schematic block diagram showing the preferred exemplary processing steps to produce the fabrics of this invention;

FIG. 2A is a photograph at a magnification of 250× of one possible patterned precursor fabric (i.e., prior to napping and shearing) in accordance with the present invention; and FIG. 2B is a photograph at a magnification of 250× showing the finished fabric state of the precursor fabric depicted in FIG. 2A (i.e., subsequent to napping and shearing).

DETAILED DESCRIPTION OF THE INVENTION

Accompanying FIG. 1 depicts schematically the principal manufacturing steps employed to produce the fabrics of this invention. Specifically, warp and filling (weft) yarns 10, 12 are supplied to a weaving loom 14 and woven together in a known manner so as to produce a woven precursor fabric 16 having a desired raised pattern on its surface. The precursor fabric 16 may be taken up on roll 16-1 at position A for further processing to be described below.

Important to the present invention, the precursor fabric is formed with raised pattern areas adjacent to recessed ground areas. Most preferably, the precursor fabric is woven using Jacquard weaving techniques. Most preferably, the precursor fabric of this invention is such that the filling yarns on selected sections on the fabric face are covered by warp yarn to form a desired pattern. Specifically, the filing yarns will most preferably form the raised pattern regions on the fabric face while the warp yarn forms the recessed ground regions. Moreover, according to the present invention, the weaving loom 14 is controlled so that the filling yarns have no evident pile structure. In other words, the individual filling yarns exposed on the face of the fabric 16 are substantially parallel to the fabric plane and do not have any substantial component thereof which is outside the fabric plane. This construction of the fabric 16 thus makes the yarns forming the raised pattern areas more susceptible to subsequent napping while the yarns forming the recessed ground areas are less susceptible to subsequent napping.

The most preferred precursor fabric construction will have between about 75 to about 300 ends per inch, and between about 16 to about 120 picks per inch. The warp yarns are most preferably between about 70 denier filament to about 300 denier filament, 10/1 spun to about 30/1 spun (including 2-ply yarns). The filling yarns are most preferably filament yarns of between about 200 denier to about 1600 denier and/or spun yarns having a cotton count of 30/1 to 1/1 (including 2-ply yarns). Advantageously, a suitable backing material, e.g., frothed acrylic latex, may be applied to the back side of the precursor fabric 16.

Virtually any type of natural and/or synthetic fibers may be employed in the yarns 10, 12. Furthermore, the fibers may be formed of spun staple fibers, multiple continuous filaments and combinations thereof. Thus, natural fibers such as cotton, wool and the like may be employed, as well as fibers manufactured from natural materials, such as regenerated cellulose (rayon). In addition, or alternatively, synthetic fibers made from melt-spinnable polymers may be employed such as nylon, polyester, polyolefin (e.g., polypropylene, polyethylene and the like), acrylic, acetate and the like. Blends of natural and synthetic fibers may also be employed (e.g., cotton/polyester blends, cotton/acrylic and the like). Furthermore, two or more natural fibers and/or two or more synthetic fibers to obtain desirable yarn properties and attributes.

The roll 16-1 of precursor fabric 16 may then be transferred to another processing position B so as to supply the napper system 18. Alternatively, the precursor fabric 16 may be supplied to the napper system 18 directly from the loom 14, if desired. However, if desired, prior to being treated by the napper system 18, the precursor fabric 16 may be subjected to a variety of intermediate processing treatments (identified in FIG. 1 by block 17) as may be desired for the final end use application of the finished fabric. Thus, for example, the fabric 16 may be supplied to the napper system 18 in the loomstate as shown, or may be dyed, backcoated, softened, printed, bleached, scoured and/or heatset prior to being subjected to the napper system 18. Furthermore, the individual yarns 10, 12 may be treated, sized, dyed and the like as may be needed and/or desired.

Accompanying FIG. 2A shows one exemplary precursor fabric 16 according to the present invention having predetermined raised pattern regions 16*a* adjacent to surrounding recessed ground regions 16*b*. As can be seen, the yarns of the raised pattern regions 16*a* have no discernible or evident pile structure, but instead are disposed substantially parallel to the plane of the fabric 16.

The napper system 18 is, in and of itself conventional. Thus, the napper system 18 contains a napper wheel 18-1 carrying a dense plurality of napper wires 18-2. The face of the precursor fabric 16 is brought into contact with the napper wires 18-2 of the napper wheel 18-1 so as to nap those fibers forming the pattern areas while the remaining fibers of the surrounding ground areas of the fabric remain substantially unnapped.

The napped precursor fabric (now designated 16-2) is thereafter transferred to a shearing system 20 where the napped yarns forming the raised pattern areas are sheared. Again, the yarns of the recessed ground regions are substantially unaffected by the shearing process. That is, the fabric 16-2 is non-uniformly napped by virtue of the yarns of the raised regions being more susceptible to such processing as compared to the yarns of the recessed ground regions. Shearing of the napped yarns thereby produces a finished fabric 22 which has velvet-like raised pattern regions and non-velvet-like recessed ground regions. The finished fabric 22 may be taken up on a roll 22-1 for further processing into finished goods (e.g., as upholstered furniture or the like).

Accompanying FIG. 2B shows an exemplary finished fabric 22 in accordance with the present invention. Specifically, the finished fabric 22 depicted in FIG. 2B is the visible state of the precursor fabric 16 following treatment in the napper and shearing systems 18, 20, respectively. As is evident, the finished fabric 22 has velvet-like pattern areas 22*a* corresponding to the raised pattern regions 16*a* of the precursor fabric 16 and non-velvet-like areas 22*b* corresponding to the recessed ground regions 16*b* of the precursor fabric 16. In this regard, it will be noted that the yarns of the ground regions 16*b* have been substantially unaffected by the napping and shearing processes.

EXAMPLES

The following precursor fabric constructions A–H were made:

| | |
|---|---|
| A: | 150 ends/inch of 150 denier polyester<br>52 picks/inch of 16/2 cotton |
| B: | 100 ends/inch of 150 denier polyester<br>40 picks/inch of 10/2 polyester |
| C: | 100 ends/inch of 150 denier polyester<br>36 picks/inch of 2/400/200 denier polyester |
| D: | 100 ends/inch of 150 polyester<br>28 picks/inch of 4/1 cotton |
| E: | 100 ends/inch of 150 denier polyester<br>40 picks/inch of 6/1 cotton |
| F: | 150 ends/inch of 150 denier polyester<br>30 picks/inch of 950 denier polypropylene |
| G: | 100 ends/inch of 150 denier polyester<br>24 picks/inch of 4/2 cotton |
| H: | 100 ends/inch of 150 denier polyester<br>28 picks/inch of 4/2 rayon |

The precursor fabrics A–H were subjected to napping and shearing as described previously. Following such treatments, each fabric exhibited velvet-like raised pattern areas and non-velvet-like recessed ground areas.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A Jacquard fabric with substantially no pile structure formed of first and second yarns which are respectively more and less affected by napping, and having a napped raised pattern area formed of said first yarn which is substantially napped and severed, and having a recessed ground pattern formed of said second yarn which is substantially unnapped.

2. The fabric of claim 1, having between about 75 to about 300 ends per inch, and between about 16 to about 120 picks per inch.

3. The fabric of claim 1, wherein said first yarn is filling yarn, and wherein said second yarn is warp yarn.

4. The fabric of claim 1, wherein each of the first and second yarns is selected from the group consisting of natural fibers, synthetic fibers and blends thereof.

5. The fabric of claim 1, which is backcoated.

6. The fabric of claim 3, wherein said filling yarn is a filament yarn of between about 200 denier to about 1600 denier.

7. The fabric of claim 3, wherein the filling yarn is a spun yarn having a cotton count of 30/1 to 1/1 spun.

8. The fabric of claim 3, wherein the warp yarn is between about 70 denier to about 300 denier.

9. The fabric of claim 8, wherein the warp yarns are spun yarns having a cotton count of between about 10/1 to about 30/1.

* * * * *